US008801639B2

(12) United States Patent
Malosio et al.

(10) Patent No.: US 8,801,639 B2
(45) Date of Patent: Aug. 12, 2014

(54) BIOMEDICAL DEVICE FOR ROBOTIZED REHABILITATION OF A HUMAN UPPER LIMB, PARTICULARLY FOR NEUROMOTOR REHABILITATION OF THE SHOULDER AND ELBOW JOINT

(75) Inventors: Matteo Malosio, Biassono (IT); Nicola Pedrocchi, Iseo (IT); Lorenzo Molinari Tosatti, Bergamo (IT)

(73) Assignee: C.N.R. Consiglio Nazionale Delle Ricerche, Rome (IT)

( * ) Notice: Subject to any disclaimer, the term of this patent is extended or adjusted under 35 U.S.C. 154(b) by 0 days.

(21) Appl. No.: 13/876,433

(22) PCT Filed: Sep. 27, 2011

(86) PCT No.: PCT/IB2011/054247

§ 371 (c)(1), (2), (4) Date: May 21, 2013

(87) PCT Pub. No.: WO2012/042471

PCT Pub. Date: Apr. 5, 2012

(65) Prior Publication Data

US 2013/0237883 A1 Sep. 12, 2013

(30) Foreign Application Priority Data

Sep. 28, 2010 (IT) ..... MI2010A001769

(51) Int. Cl.
*A61H 1/00* (2006.01)
*A61H 1/02* (2006.01)

(52) U.S. Cl.
USPC ..... 601/33; 601/2; 601/23; 482/139

(58) Field of Classification Search
CPC ..... A61H 1/02; A61H 1/0274; A61H 1/0277; A61H 2205/06
USPC ..... 601/5, 23, 33, 27, 32, 24, 40; 482/4–9, 482/92, 124, 139, 148
See application file for complete search history.

(56) References Cited

U.S. PATENT DOCUMENTS 3,449,769 A * 6/1969 Mizen ..... 623/26
2003/0115954 A1 * 6/2003 Zemlyakov et al. ..... 73/379.01

(Continued)

FOREIGN PATENT DOCUMENTS

WO WO 95/32842 A2 12/1995

OTHER PUBLICATIONS

International Search Report for corresponding International Patent Application No. PCT/IB2011/054247 mailed Jan. 19, 2012.

*Primary Examiner* — Justine Yu
*Assistant Examiner* — Timothy Stanis
(74) *Attorney, Agent, or Firm* — Merchant & Gould P.C.

(57) ABSTRACT

A biomedical device (1) for robotized rehabilitation of a human upper limb, particularly for neuromotor rehabilitation of the shoulder and elbow joint, includes a first rigid rod (2) and a second rigid rod (3), both of which can be associated with the upper limb (4) of a patient (5) and are articulated to each other at two adjacent ends (2*a*, 3*a*) thereof by way of a first universal joint (6) which can be arranged proximate to the elbow joint (7) of the upper limb (4). The first rigid rod (2) and the second rigid rod (3) are associable respectively with the forearm (28) and the arm (13) of the upper limb (4) by joints with four degrees of freedom, of which three are rotary (35, 36, 37, 46, 47, 48) and one is translational (38, 49) and aligned with the longitudinal axis, respectively, of the forearm (28) or of the arm (13), the first universal joint (6) having pivoting axes (54, 55) which are mutually perpendicular and angled with respect to the longitudinal axis of the arm (13) to prevent a condition of kinematic singularity during alignment between the forearm (28) and the arm (13).

7 Claims, 5 Drawing Sheets

(56) References Cited

U.S. PATENT DOCUMENTS

2006/0150753 A1 7/2006 Massimo et al.
2007/0225620 A1* 9/2007 Carignan et al. ..... 601/5
2008/0009771 A1 1/2008 Perry et al.
2009/0149783 A1* 6/2009 Nef et al. ..... 601/5
2010/0113987 A1* 5/2010 Agrawal et al. ..... 601/33
2010/0144490 A1* 6/2010 Purdy et al. ..... 482/1
2010/0204804 A1* 8/2010 Garrec ..... 623/24

* cited by examiner

BIOMEDICAL DEVICE FOR ROBOTIZED REHABILITATION OF A HUMAN UPPER LIMB, PARTICULARLY FOR NEUROMOTOR REHABILITATION OF THE SHOULDER AND ELBOW JOINT

This application is a National Stage Application of PCT/IB2011/054247, filed 27 Sep. 2011, which claims benefit of Serial No. MI2010A001769, filed 28 Sep. 2010 in Italy and which applications are incorporated herein by reference. To the extent appropriate, a claim of priority is made to each of the above disclosed applications.

TECHNICAL FIELD

The present invention relates to a biomedical device for robotized rehabilitation of a human upper limb, particularly for neuromotor rehabilitation of the shoulder and elbow joint.

BACKGROUND ART

Nowadays, in order to improve and optimize techniques of neuromotor rehabilitation of limbs of the human body, it is known art to avail of motorized systems able of assisting the patient in the different movements necessary to recover the limb to be rehabilitated.

More precisely, biomedical devices of the robotized type are known which are able of interacting with the patient thus ensuring that the movement of the musculoskeletal apparatus follows the physiological movement of the treated limb and of the joints involved in the movement, while at the same time providing a breadth of movement that is as extensive as possible, within the limits of the actual movements performed by the limb affected by rehabilitation.

In particular, for the upper limbs of the human body, biomedical devices of the motorized type for neuromotor rehabilitation are known which substantially comprise an exoskeleton that can be fitted over the patient's upper limb to be rehabilitated, and are composed of two or more rigid rods which are articulated to each other with a plurality of degrees of freedom and are provided with a plurality of electric motors which are adapted to help the patient to perform the movements necessary for rehabilitation.

In more detail, conventional robotized biomedical devices for neuromotor rehabilitation of the upper limb are provided with a first rigid rod, to which the arm of the patient is attached, and which is articulated to the supporting structure by way of a first mechanical joint that is able of replicating, as far as is possible, the physiological movements of the shoulder, and a second rigid rod, to which the forearm of the patient is attached and which is articulated to the first rigid rod by way of a second mechanical joint for replicating the movements of the elbow joint.

In some cases, the second rigid rod is serially coupled to a mechanical joint, that can be gripped by the patient, in order to enable the rehabilitation of the physiological movements of the wrist.

The robotized biomedical devices of the known type suffer two critical aspects. The first consists in the intrinsic singularity of the exoskeletal structure in the event of complete extension of the forearm (alignment of the arm-forearm axis) and the second consists in the approximation of the movement of the shoulder girdle and thus of the real center of instantaneous rotation of the arm (movement of the head of the humerus with respect to a fixed outer system of reference).

As can be seen in several devices, the kinematic singularity that can arise if arm and forearm are aligned does not allow the patient, in certain defined rehabilitation sessions, to modify the rotation axis of the elbow (and thus to perform movements of inner/outer rotation of the shoulder about the axis of the arm) with the forearm extended, since the kinematic singularity of the exoskeleton would not allow the exoskeleton to modify the configuration of its joints consistently and to keep the axis of the exoskeleton corresponding to the flexion/extension of the elbow aligned with the actual rotation axis of the elbow joint. A loss of mutual parallelism of these axes owing to a corresponding rotation about the axis of the arm would have an impact on the effective reversibility of the exoskeleton at the elbow.

Moreover, the head of the humerus, which can be identified as the center of instantaneous rotation of the shoulder, in general physiologically performs a combined movement of rotary and translational motion owing to the movement of the shoulder girdle in the three Cartesian dimensions and simplifying it with compound movements characterized by one or two degrees of freedom is an approximation.

Nevertheless, the articulation of the shoulder is viewed, in some relatively simple conventional devices, as a merely spherical joint without taking account of the actual kinematic movement of the shoulder girdle. In fact in the exoskeleton, i.e. in the kinematic structure that can be applied to the patient, rotations about three concurrent axes are possible, but translational motions of the center of instantaneous rotation are not possible.

Some more advanced robotized biomedical devices comprise means designed to shift the center of instantaneous rotation of the exoskeleton, in order to allow the combined rotary and translational motion of the actual center of instantaneous rotation of the shoulder.

For example, robotized biomedical devices are known in which the center of instantaneous rotation can rotate about an axis, thus approximating the trajectory described by the actual center of instantaneous rotation with an arc of circumference. In this type of biomedical device, despite the rotation made possible in the center of instantaneous rotation, there are still limits on the possible movements of the shoulder girdle.

A development of the robotized biomedical device just described makes it possible to perform two distinct rotations about two axes that are perpendicular to each other in the center of instantaneous rotation. In this way, the shoulder enjoys five degrees of freedom, thus achieving a good solution in kinematic terms.

In another example of robotized biomedical devices of the known type, the center of instantaneous rotation can perform vertical translational movements in following the variations of the actual center of instantaneous rotation of the shoulder.

Thanks to the construction of these devices, this compensation is along the vertical direction only, i.e. in the direction that is still the most appreciable for the problem under discussion.

DISCLOSURE OF THE INVENTION

The aim of the present invention consists in providing a biomedical device for robotized rehabilitation of a human upper limb, particularly for neuromotor rehabilitation of the shoulder and elbow joint, which is able of interacting with the patient thus ensuring that the movement of the musculoskeletal apparatus follows the physiological movement of the treated limb and of the joints involved in the movement, while at the same time providing a breadth of movement that is as extensive as possible, within the limits of the actual movements performed by the limb affected by rehabilitation, for the articulation both of the elbow and of the shoulder.

Within this aim, an object of the present invention consists in providing a biomedical device that is simple to implement, easy to use and at low cost when compared to conventional biomedical devices.

This aim and this and other objects which will become better apparent hereinafter are achieved by a biomedical device for robotized rehabilitation of a human upper limb, particularly for neuromotor rehabilitation of the shoulder and elbow joint, comprising a first rigid rod and a second rigid rod, both of which can be associated with the upper limb of a patient and are articulated to each other at two adjacent ends thereof by way of a first universal joint which can be arranged proximate to the elbow joint of said upper limb, characterized in that said first rigid rod and said second rigid rod are associable respectively with the forearm and the arm of said upper limb by way of joints with four degrees of freedom, of which three are rotary and one is translational and aligned with the longitudinal axis, respectively, of said forearm or of said arm, said first universal joint having pivoting axes which are mutually perpendicular and angled with respect to the longitudinal axis of said arm in order to prevent a condition of kinematic singularity during alignment between said forearm and said arm.

BRIEF DESCRIPTION OF THE DRAWINGS

Further characteristics and advantages of the present invention will become better apparent from the description of preferred, but not exclusive, embodiments of a biomedical device for robotized rehabilitation of a human upper limb, particularly for neuromotor rehabilitation of the shoulder and elbow joint, according to the invention, which are illustrated, by way of non-limiting example, in the accompanying drawings, wherein.

WAYS OF CARRYING OUT THE INVENTION

Figure 1:
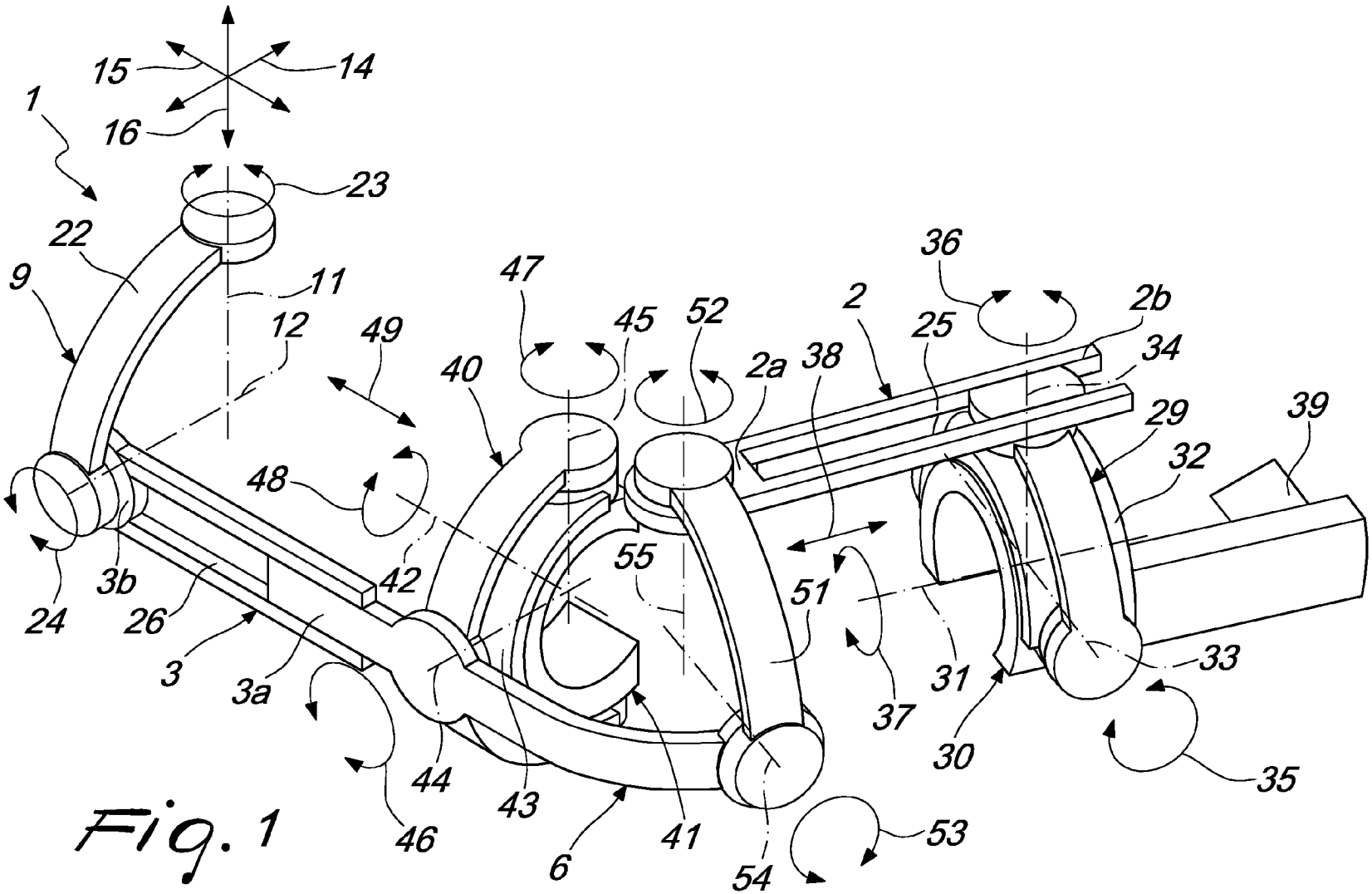
FIG. 1 is a perspective view of an embodiment of a biomedical device for robotized rehabilitation of a human upper limb, particularly for neuromotor rehabilitation of the shoulder and elbow joint, according to the invention.

With reference to the figures, the biomedical device for robotized rehabilitation of a human upper limb, particularly for neuromotor rehabilitation of the shoulder and elbow joint, generally designated by the reference numeral 1, comprises a first rigid rod 2 and a second rigid rod 3 which can both be associated with the upper limb 4 of a patient 5 and are articulated to each other at two adjacent ends 2*a* and 3*a* thereof by way of a first universal joint 6 which can be arranged proximate to the elbow joint 7 of the upper limb 4.

More precisely, the center of the first universal joint 6 can be arranged proximate to the elbow joint 7 in the initial positioning step, i.e. during the application of the biomedical device 1 to the patient 5.

Conveniently, the second rigid rod 3 is articulated to a supporting structure 8 at the other end 3*b* thereof by way of a second universal joint 9 which can be arranged substantially proximate to the glenohumeral joint of the shoulder 10 of the upper limb 4 and which has pivoting axes 11 and 12 which are perpendicular to each other and are substantially perpendicular to the longitudinal axis of the arm 13 of the upper limb 4. The reference numeral 60 designates the shoulder girdle of the patient 5.

Such arrangements of the universal joints 6 and 9 are also made possible thanks to the presence of first means of adjusting the length of the first rigid rod 2 and second means of adjusting the length of the second rigid rod 3 which consist, substantially, of two telescopic rails 25 and 26, which define, respectively, the distance between the center of the glenohumeral joint of the shoulder 10 and the center of the elbow joint 7 and the position of the joint located at the wrist 27 of the upper limb 4.

In this manner it is possible to use the same biomedical device 1 on patients 5 having different anthropometric values.

Advantageously, the second universal joint 9 is movable along a set of three Cartesian axes 14, 15 and 16 with respect to the supporting structure 8, or similar structure, which enables the initial positioning of the second universal joint 9 with respect to the glenohumeral joint of the shoulder 10.

In one of the possible constructive solutions, the supporting structure 8 is composed of a base 17 to which the body of the patient 5 is firmly attached, for example, by way of an adapted chair 18 and from which a telescopic column 19 vertically extends, in turn supporting two horizontal arms 20 and 21 which are movable and of which one is associated with the end 3*b* of the second rigid rod 3, so as to enable the initial positioning of the center of the second universal joint 9 proximate to the center of the glenohumeral joint of the shoulder 10.

The second universal joint 9 thus provides a joint with two degrees of freedom which can be arranged in the space along the Cartesian axes 14, 15 and 16 and is interposed between the horizontal arm 20 of the supporting structure 8 and the end 3*b* of the second rigid rod 3.

In the present case, the second universal joint 9 comprises a rigid body 22 pivoted to the end 3*b* and to the horizontal arm 20 thus enabling, respectively, rotations 23 and 24, respectively about the two pivoting axes 11 and 12 which are at right angles to each other and intersect in the center of the second universal joint 9.

The second universal joint 9 determines the orientation of the second rigid rod 3 with respect to a system of reference that is integral with the base 17.

According to the invention, the first rigid rod 2 and the second rigid rod 3 can be associated, respectively, with the forearm 28 and with the arm 13 of the upper limb 4 by way of joints with four degrees of freedom of which three are rotary and one is translational and aligned with the longitudinal axis, respectively, of the forearm 28 or of the arm 13.

More specifically, the joint with four degrees of freedom relating to the first rigid rod 2 comprises a first spherical joint 29 which is associated with the other end 2*b* of the first rigid rod 2 by way of a first fixing element 30 which can be fixed rigidly to the forearm 28, substantially between the elbow joint 7 and the wrist joint 27.

The first fixing element 30, which can for example consist of an armlet-shaped body so as to be able of being worn by the patient 5 without difficulty, is movable with respect to the first spherical joint 29 along a first direction of translational motion 31 which coincides substantially with the longitudinal axis of the forearm 28.

This mobility is made possible thanks to the presence of a first guiding element 32 which is associated rotatably with the first rigid rod 2 about two rotation axes 33 and 34 which are perpendicular to each other and are perpendicular to the first direction of translational motion 31.

The first spherical joint is thus indeed provided by the element 29 and by the rotation of the guiding element 32 about the axis 31.

Conveniently, the first fixing element 30 is slideably and rotatably associated with the first guiding element 32, respectively, along and about the first direction of translational motion 31, by way of an adapted cylindrical joint constituted by one degree of rotational freedom 37 and by one degree of translational freedom 38.

In this manner three degrees of rotational freedom 35, 36 and 37 (spherical joint) are obtained, with axes incident on the center of the first spherical joint 29, and one degree of freedom in translation 38 placed kinematically in series with the first spherical joint 29 and aligned with the forearm 28 of the patient 5, i.e. along the line ideally joining the center of the elbow joint 7 with the center of the wrist joint 27.

The first guiding element 32 rotates about the first spherical joint 29 according to the rotation 35 and the first spherical joint 29 rotates about the end 2*b* according to the rotation 36.

Moreover, in order to facilitate interaction between the patient 5 and the biomedical device 1, a handgrip 39 (or equivalent locking system for rigidly coupling the element 30 to the forearm 28) can be provided which is integral with the first fixing element 30 and which can easily be gripped by the patient 5.

Similarly, the joint with four degrees of freedom relating to the second rigid rod 3 comprises a second spherical joint 40 associated with the end 3*a* of the second rigid rod 3 by way of a second fixing element 41 that can be rigidly fixed to the arm 13, substantially between the glenohumeral joint of the shoulder 10 and the elbow joint 7.

Such second fixing element 41, which can for example consist of an armlet-shaped body so as to be able of being worn by the patient 5 without difficulty, is movable with respect to the second spherical joint 40 along a second direction of translational motion 42 which coincides substantially with the longitudinal axis of the arm 13.

This mobility is made possible thanks to the presence of a second guiding element 43 which is associated rotatably with the second rigid rod 3 about two rotation axes 44 and 45 which are perpendicular to each other and are perpendicular to the second direction of translational motion 42.

Conveniently, the second fixing element 41 is slideably and rotatably associated with the second guiding element 43, respectively, along and about the second direction of translational motion 42, by way of an adapted cylindrical joint constituted by one degree of rotational freedom 48 and by one degree of translational freedom 49.

In this manner three degrees of rotational freedom 46, 47 and 48 (spherical joint) are obtained, with axes incident on the center of the second spherical joint 40, and one degree of freedom in translation 49 placed kinematically in series with the second spherical joint 40 and aligned with the arm 13 of the patient 5, i.e. along the line ideally joining the center of the glenohumeral joint of the shoulder 10 with the center of the elbow joint 7.

As mentioned previously, the rigid rods 2 and 3 are articulated to each other by way of the first universal joint 6 which comprises a rigid body 51 pivoted to the adjacent ends 2*a* and 3*a* of the rigid rods 2 and 3 thus enabling, respectively, rotations 52 and 53, respectively about two pivoting axes 55 and 54 which are at right angles to each other and intersect in the center of the first universal joint 6.

Advantageously, such first universal joint 6, which determines the mutual orientation between the first rigid rod 2 and the second rigid rod 3, has the pivoting axes 54 and 55 angled with respect to the longitudinal axis of the arm 13, and more precisely the axis 54 is not parallel to the longitudinal axis of the arm 13, in order to prevent a condition of kinematic singularity during the alignment of the forearm 28 with the arm 13 in the event of complete extension of the elbow 7.

Figure 4:
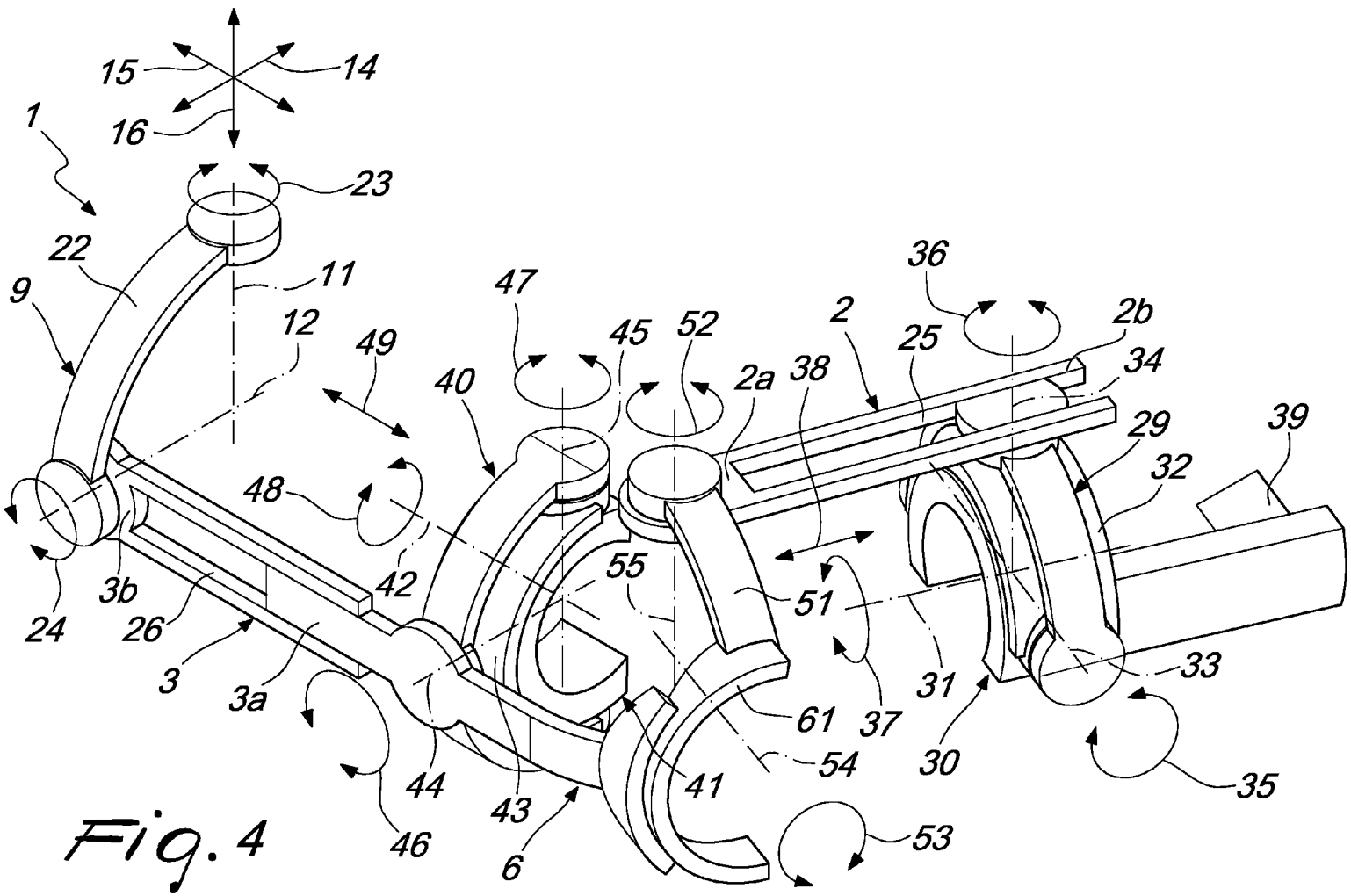
FIG. 4 is a perspective view of a further embodiment of the biomedical device according to the invention.
Figure 5:
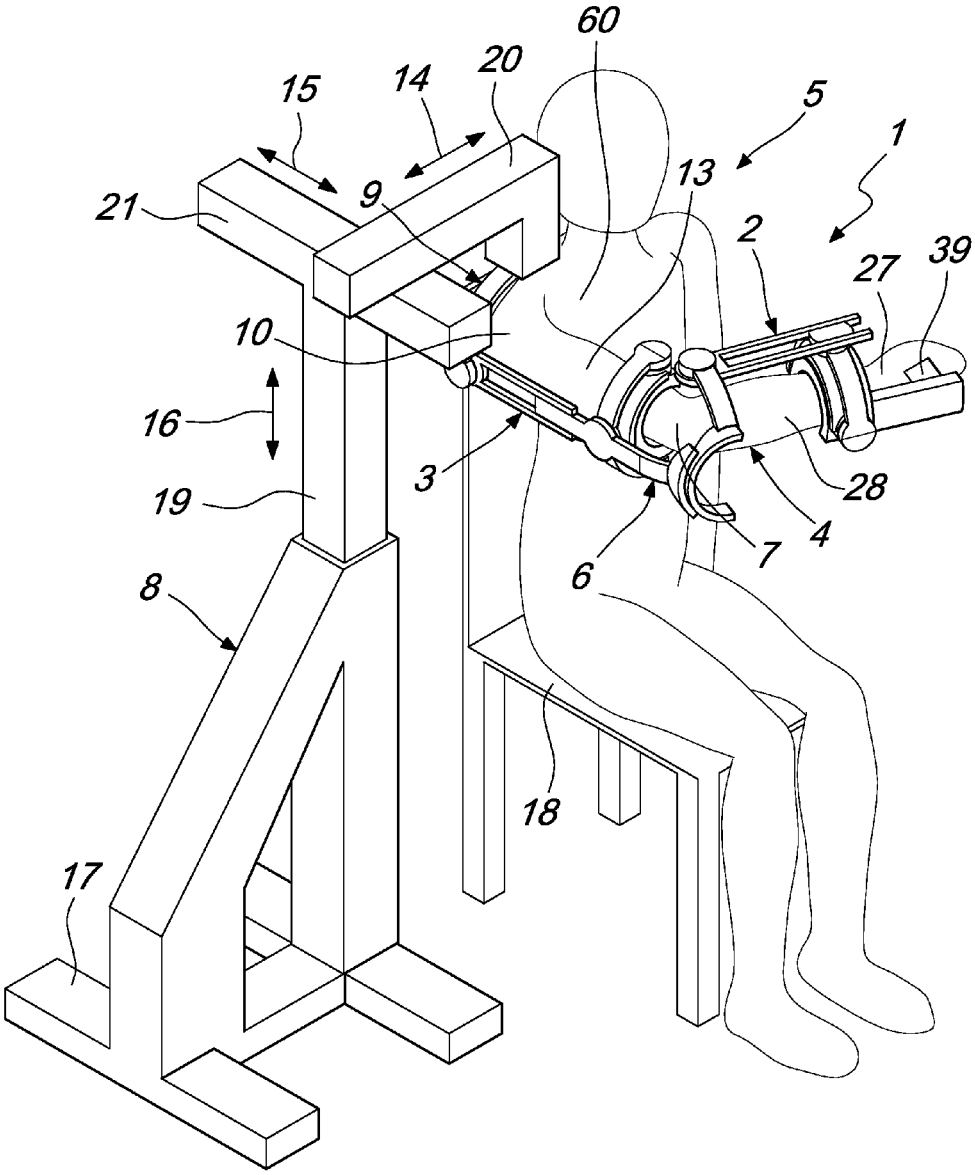
FIG. 5 is a perspective view of the biomedical device shown in FIG. 4 applied to a patient.

FIG. 4 shows a second embodiment of the device according to the invention, in which, differently from the first embodiment, the first universal joint 6 which can be arranged proximate to the elbow of the patient is made so as to be shorter than its corresponding component in the first embodiment, so as to not overlap with the elbow of the patient and thus permit a greater freedom of movement of the forearm and the complete extension of the elbow.

Therefore, the rigid body 51 is made in such a way as to have a curved portion 61 that allows a better accommodation of the elbow of the patient.

Operation of the biomedical device 1 for robotized rehabilitation of a human upper limb, particularly for neuromotor rehabilitation of the shoulder and elbow joint, is described below.

Once the patient 5 is in position with respect to the supporting structure 8 and the fastening elements 30 and 41 are suitably fastened to the arm 13 and to the forearm 28, the patient 5 is kinematically coupled to the exoskeleton defined by the biomedical device 1.

More precisely, the step of positioning the exoskeleton with respect to the upper limb 4 of the patient 5 occurs by positioning the point of intersection of the pivoting axes 11 and 12 at the glenohumeral joint of the shoulder 10.

Figure 2:
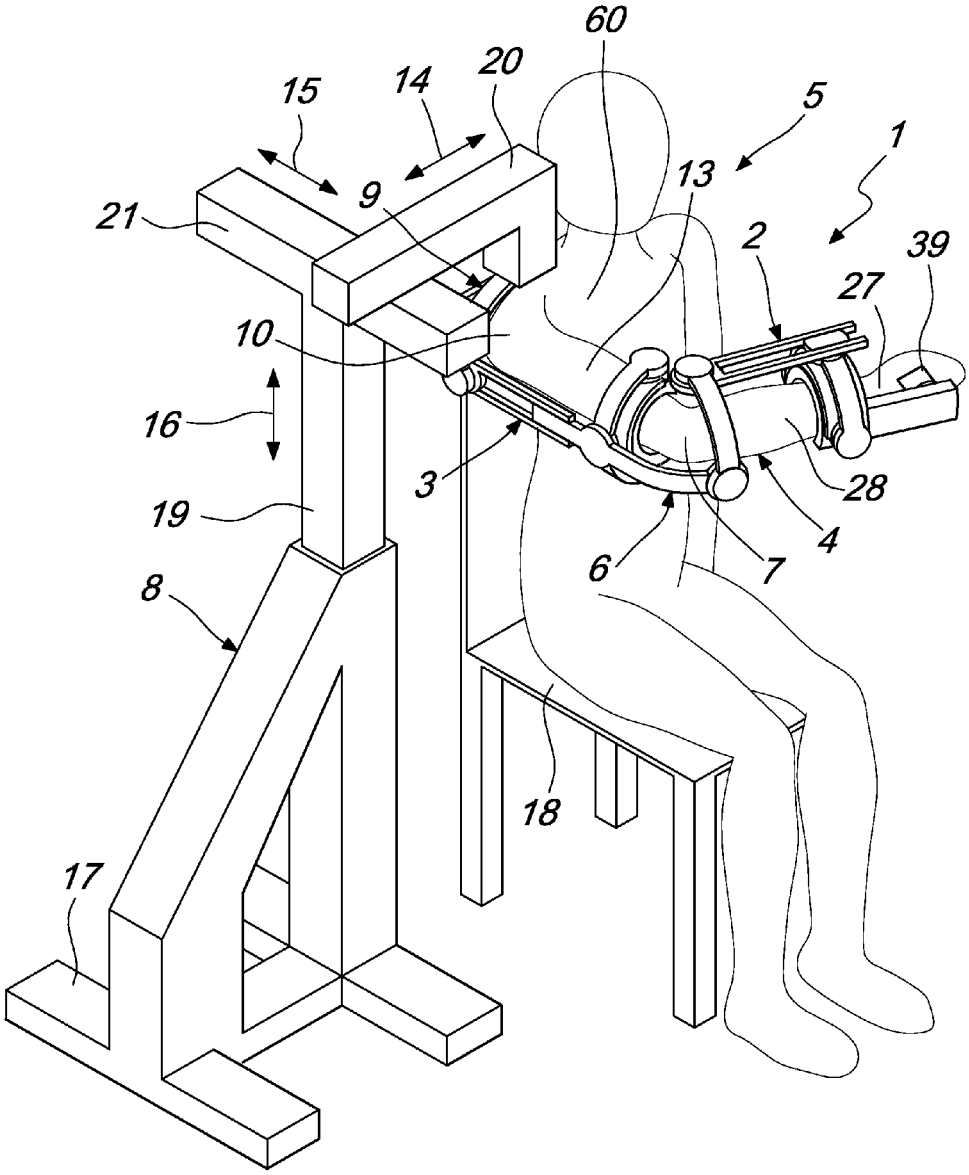
FIG. 2 is a perspective view of the biomedical device shown in FIG. 1 applied to a patient.
Figure 3:
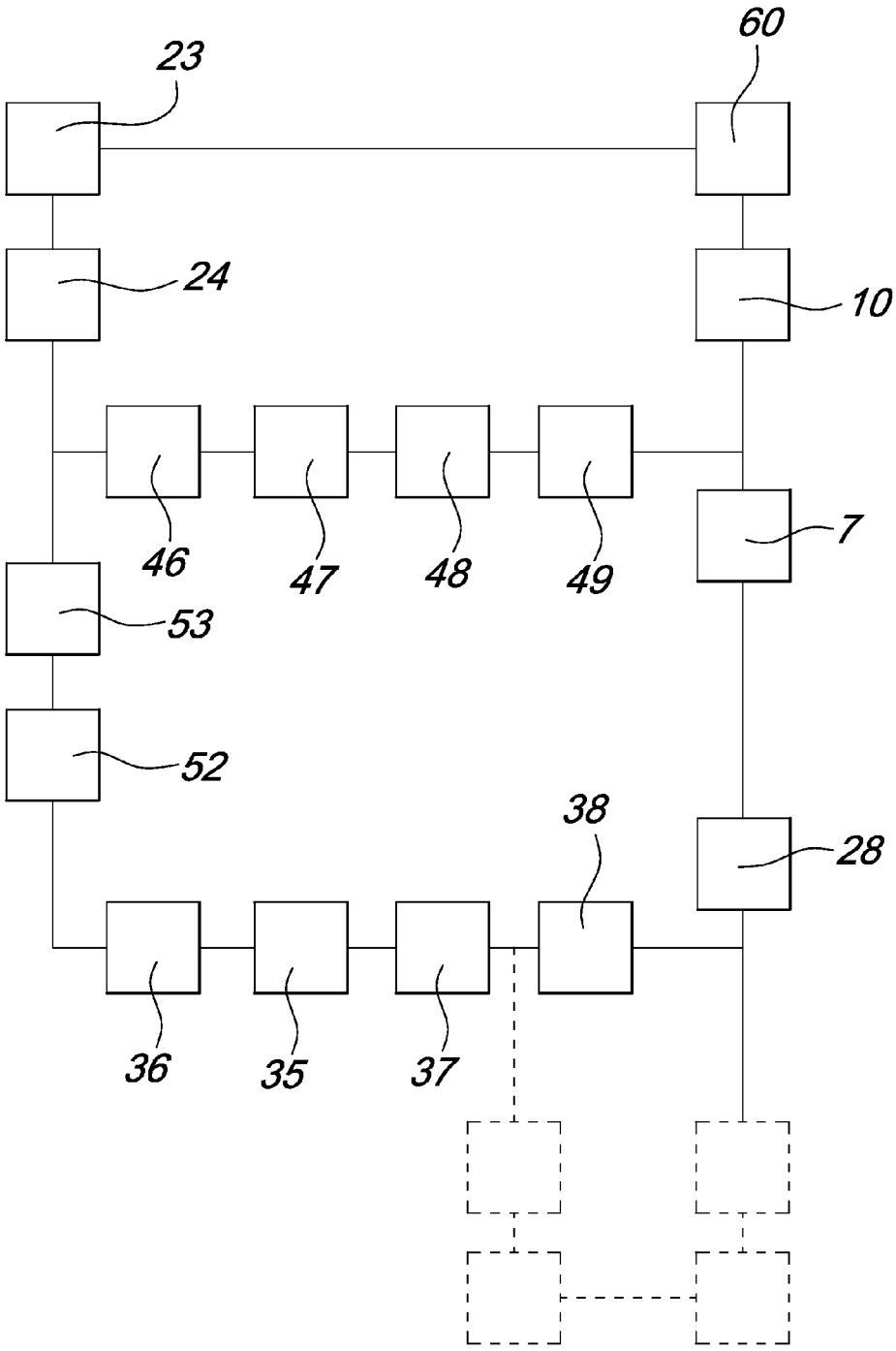
FIG. 3 is a schematic representation of the kinematic architecture of the biomedical device shown in FIG. 1.

In the embodiment proposed and shown in FIGS. 1 and 2, this occurs by acting on the degrees of freedom 14, 15 and 16 of the supporting structure 8.

The upper limb 4 to which the fastening elements 30 and 41 are fastened is moved by the exoskeleton by way of motors that actuate it during the rehabilitation exercises.

In more detail, the movements of the exoskeleton are controlled by a control system that is able of consistently moving some of the degrees of freedom described previously.

For example, the movement of the biomedical device 1 can occur by actuating the universal joints 6 and 9, in particular according to the degrees of freedom 53, 52, 23 and 24. The other degrees of freedom in this case are not actuated and this permits the upper limb 4 to autonomously adapt to the position imposed by the exoskeleton.

Differently, the movement of the biomedical device 1 can occur by actuating, in addition to the universal joints 6 and 9, the degrees of freedom 46, 47 and 49 for a set positioning of the center of the glenohumeral joint of the shoulder 10. The other degrees of freedom remain un-actuated in order to allow correct self-positioning of the arm 13 and of the forearm 28 with respect to the structure of the biomedical device 1.

In practice it has been found that the biomedical device for robotized rehabilitation of a human upper limb, particularly for neuromotor rehabilitation of the shoulder and elbow joint, according to the present invention, fully achieves the intended aim and objects in that, thanks to the skewing of the axis 54 with respect to the axis 42 of the arm 13, which is able of preventing the condition of singularity of the exoskeleton in the event of the elbow being completely extended, and thanks to the mobility provided by the joints with four degrees of freedom through which the arm and forearm are coupled to the mechanism described, it makes it possible to constantly interact with the patient thus ensuring that the movement of the musculoskeletal apparatus follows the physiological movement of the treated limb and of the joints involved in the movement, while at the same time providing an extended breadth of movement and a greater capacity for movement, within the limits of the actual movements performed by the upper limb of the patient, with respect to conventional devices available up to now.

The biomedical device for robotized rehabilitation of a human upper limb, particularly for neuromotor rehabilitation of the shoulder and elbow joint, thus conceived, is susceptible of numerous modifications and variations, all of which are within the scope of the inventive concept.

The biomedical device 1 and the corresponding control system can be interfaced with a virtual reality system, in order to simulate interaction with a virtual world, and with other devices useful for neuromotor rehabilitation.

For example, the biomedical device and the corresponding control system can be interfaced with electromyographs, electrostimulators and systems for electroencephalographic analysis.

Moreover, the biomedical device 1, by way of adapted movements of the universal joints, enables a rapid reconfiguration in order to be used both for the rehabilitation of the right limb and of the left limb.

Moreover, the joints, which are shown concisely in FIG. 2, can be provided with adapted sensors of force and torque for performing advanced rehabilitative exercises, able of interacting with the actual effort exchanged with the patient.

The biomedical device, thus conceived, is susceptible of numerous modifications and variations, all of which are within the scope of the appended claims. Moreover, all the details may be substituted by other, technically equivalent elements.

In practice the materials employed, provided they are compatible with the specific use, and the contingent dimensions and shapes, may be any according to requirements and to the state of the art.

Where the technical features mentioned in any claim are followed by reference numerals and/or signs, those reference numerals and/or signs have been included for the sole purpose of increasing the intelligibility of the claims and accordingly, such reference numerals and/or signs do not have any limiting effect on the interpretation of each element identified by way of example by such reference numerals and/or signs.

The invention claimed is:

1. A biomedical device for robotized rehabilitation of a human upper limb, particularly for neuromotor rehabilitation of a shoulder and elbow joint, comprising:

a first rigid rod and a second rigid rod, the first rigid rod being rotatable connected to the second rigid rod at two adjacent ends by a first universal joint having a first pivoting axis and a second pivoting axis, the first pivoting axis being perpendicular to the second pivoting axis, the first rigid rod and the second rigid rod adapted to be connectable with an upper limb of a patient so that the first universal joint is arranged proximate to an elbow joint of said upper limb;

a first fixing element adapted to be rigidly fixed to a forearm of said upper limb substantially between said elbow joint and a wrist joint of said upper limb;

wherein said first fixing element is connected to said first rigid rod by a four degrees-of-freedom joint having three rotary degrees-of-freedom and one translational degree of freedom, said four degrees-of-freedom joint comprising a first spherical joint arranged at an end of said first rigid rod opposite said first universal joint, and wherein said first fixing element is translatable with respect to said first spherical joint along a first direction of translational motion;

a second fixing element adapted to be rigidly fixed to an arm of said upper limb, wherein said second fixing element is connected to said second rigid rod by a four degrees-of-freedom joint having three rotary degrees-of-freedom and one translation degree-of-freedom in a second direction of translational motion;

wherein when said first fixing element is rigidly fixed to said forearm and said second fixing element is rigidly fixed to said arm:

said first direction of translation motion substantially coincides with a longitudinal axis of said forearm and said second direction of translational motion substantially coincides with a longitudinal axis of said arm; and said first pivoting axis and said second pivot axis are orthogonal with respect to the longitudinal axis of said arm to prevent a kinematic singularity condition during alignment between said forearm and said arm.

2. The biomedical device according to claim 1, wherein said first spherical joint comprises a first guiding element, which can rotate with respect to said first rigid rod about two rotation axes which are perpendicular to each other and perpendicular to said first direction of translational motion, said first fixing element being configured so that said first fixing element can slide with respect to said first guiding element along said first direction of translational motion; and said first fixing element can rotate with respect to said first guiding, element around said first direction of translational motion.

3. The biomedical device according to claim 2, wherein said first fixing element is provided with a handgrip that can be gripped by said patient.

4. The biomedical device according to claim 1, comprising a first telescopic rail for adjusting the length of said first rigid rod.

5. The biomedical device according to claim 4, comprising a second telescopic rail for adjusting the length of said second rigid rod.

6. A biomedical device for robotized rehabilitation of a human upper limb, particularly for neuromotor rehabilitation of a shoulder and an elbow joint, comprising:

a first rigid rod and a second rigid rod, said first rigid rod being rotatably connected to the second rigid rod at two adjacent ends by a first universal joint having a first pivoting axis and a second pivoting axis, the first pivoting axis being perpendicular to the second pivoting axis, the first rigid rod and the second rigid rod adapted to be connectable with an upper limb of a patient so that the first universal joint is arranged proximate to an elbow joint of said upper limb;

a first fixing element adapted to be rigidly fixed to a forearm of said upper limb substantially between said elbow joint and a wrist joint of said upper limb;

wherein said first fixing element is connected to said first rigid rod by a four degrees-of-freedom joint having three rotary degrees-of-freedom and one translational degree-of-freedom in a first direction of translational motion;

a second fixing element adapted to be rigidly fixed to an arm of said upper limb, wherein said second fixing element is connected to said second rigid rod by a four degrees-of-freedom joint having three rotary degrees-of-freedom and one translational degree-of-freedom in a second direction of translational motion;

wherein when said first fixing element is rigidly fixed to said forearm and said second fixing element is rigidly fixed to said arm:

said first direction of translational motion substantially coincides with a longitudinal axis of said forearm and said second direction of translational motion substantially coincides with a longitudinal axis of said arm; and said first pivoting axis and said second pivoting axis are orthogonal with respect to the longitudinal axis of said arm to prevent a kinematic singularity condition during alignment between said forearm and said arm;

wherein said joint with four degrees of freedom arranged at said second rigid rod comprises:

a spherical joint arranged at an adjacent end of said second rigid rod;

wherein said second fixing element is adapted to be fixed between a glenohumeral joint of the shoulder of said upper limb and said elbow joint, and wherein said second fixing element is translatable with respect to said spherical joint along a second direction of translational motion.

7. The biomedical device according to claim 6, wherein when said first fixing element if rigidly fixed to said forearm and said second fixing element is rigidly fixed to said arm, the pivoting axis of the first universal joint is orthogonal with respect to said second direction of translational motion.

* * * * *